US008205571B1

(12) United States Patent
Rondeau et al.

(10) Patent No.: US 8,205,571 B1
(45) Date of Patent: Jun. 26, 2012

(54) BOAT HAVING A TOWER

(75) Inventors: Pierre Rondeau, St-Denis-de-Brompton (CA); Claude Gagnon, Magog (CA); Sam Spade, Palm Bay, FL (US); Willy Carmine, Grant, FL (US); Joey Larouche, Mont-Saint-Hilaire (CA); Vincent Tognon, Drummondville (CA); Daniel Mercier, Magog (CA)

(73) Assignee: BRP US Inc., Sturtevant, WI (US)

( * ) Notice: Subject to any disclaimer, the term of this patent is extended or adjusted under 35 U.S.C. 154(b) by 292 days.

(21) Appl. No.: 12/363,416

(22) Filed: Jan. 30, 2009

Related U.S. Application Data

(60) Provisional application No. 61/026,648, filed on Feb. 6, 2008.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | | |
|---|---|---|---|---|
| 3,810,266 | A | 5/1974 | Iller | |
| 4,606,572 | A | 8/1986 | Maguire | |
| 4,763,947 | A | 8/1988 | Gregg | |
| 4,947,296 | A | 8/1990 | Takeuchi et al. | |
| 5,228,408 | A * | 7/1993 | Jannausch | 114/361 |
| 5,417,467 | A | 5/1995 | Viertal et al. | |
| 5,640,924 | A * | 6/1997 | Murrant | 114/361 |
| 5,660,220 | A | 8/1997 | Ruan | |
| 5,682,915 | A | 11/1997 | Martin | |
| 6,439,150 | B1 | 8/2002 | Murphy et al. | |
| 7,438,015 | B1 * | 10/2008 | Schwindaman | 114/361 |
| 7,536,971 | B1 | 5/2009 | Fry | |
| 7,571,691 | B2 * | 8/2009 | Russikoff | 114/361 |

FOREIGN PATENT DOCUMENTS

| | | | |
|---|---|---|---|
| WO | 9926520 | A1 | 6/1999 |
| WO | 2008134361 | A2 | 11/2008 |

* cited by examiner

*Primary Examiner* — Stephen Avila
(74) *Attorney, Agent, or Firm* — Osler, Hoskin & Harcourt LLP

(57) ABSTRACT

A boat has a hull and a deck is disposed on the hull. A tower is connected to the deck. The tower has a top. The top has at least one storage compartment defined therein. A canopy is connected to the top, the canopy has at least one frame member and a canvas connected to the at least one frame member. The canopy has an extended position and a retracted position. The canvas and the at least one frame member are disposed at least in part in the storage compartment of the top when the canopy is in the retracted position. A boat having a tower with a top and a canopy attached thereto is also disclosed where the tower is movable between a first position and a second position.

19 Claims, 12 Drawing Sheets

BOAT HAVING A TOWER

CROSS-REFERENCE

The present application claims priority to U.S. Provisional Application No. 61/026,648, filed Feb. 6, 2008, the entirety of which is incorporated herein by reference.

FIELD OF THE INVENTION

The present invention relates to a boat having a tower.

BACKGROUND OF THE INVENTION

Many boats, such as sport boats, have at least a portion of a deck which is opened. This means that the opened portions of the deck are not protected from the rain or sun by a cabin having a roof, for example. This can be an inconvenience to the users of the boat located in the opened portion of the deck because they are exposed to the rain or sun, as the case may be. Some boat makers and owners install removable or retractable canopies, such as bimini tops, for example, on their boats in order to protect some of the opened portions of the deck from the rain or sun when the boat is in use. Such removable or retractable canopies protect some portions of the deck from the rain or sun, while allowing the users of the boat to walk freely under such canopies.

A typical canopy has a canvas supported by a frame. The canvas is usually treated to be impermeable to water and the frame is made of a lightweight and strong material such as aluminium or other metal. A common type of canopy used to protect the deck of a boat from the rain or sun is a bimini top. The bimini top is an open-front canvas top that is supported by a metal frame attached to the right and left sides of the deck. The bimini top is usually placed over the deck such that it covers a cockpit of the boat.

Once the frame is attached to the sides of the deck, in order to set up the bimini top, the canvas is extended by moving some members of the frame relative to other members of the frame, such that the canvas is secured in tension on the frame members adapted for its support. In order to retract or close the canopy, while leaving the frame attached to the sides of the deck, the canvas can be detached from the frame and folded on itself or wrapped around a part of the frame. Alternatively, some members of the frame are moved relative to another such that the canvas becomes folded or bundled up one side of the frame.

In order to prepare the bimini top for storage, the frame with the canvas attached thereto may either be folded on itself and disposed at the rear or front portion of the deck, or the frame may be detached, folded and stored separately from the boat.

An inconvenience arising with canopies is that in order to extend the canvas, the canopy has to be manually unfolded and set up. In order to retract the canvas, the canvas has to also be either manually detached from the frame and folded, or some frame members have to be manually moved relative to each other. The manual setting up and removal may be time consuming and laborious.

Another inconvenience of most canopies is that once the canopy is set up and the canvas is extended, it cannot be moved from one position to another to cover different areas of the deck. Therefore, a user of the boat is not able to change the portion of the deck that is protected by the canopy from the rain or sun, once the canopy is set up with the canvas extended.

Therefore, there is a need for a boat having a canopy that may be extended and retracted with relative ease.

There is also a need for a boat having a canopy that may be easily adjusted to cover different areas of the deck, particularly, once the canopy is set up with the canvas extended.

There is also a need a boat having a canopy that can be stored relatively easily.

SUMMARY OF THE INVENTION

It is an object of the present invention to ameliorate at least some of the inconveniences present in the prior art.

It is also an object of the present invention to provide a boat having a movable tower for supporting a retractable canopy.

It is also an object of the present invention to provide a boat having a tower for supporting a retractable canopy, the tower having at least a storage compartment therein for receiving the canopy once it has been retracted.

In one aspect, the invention provides a boat with a hull. The hull has a bow and a stern. A deck is disposed on the hull. A tower is movably connected to the deck. The tower has a top. The tower is movable between a first tower position and a second tower position, such that the top is closer to the bow when the tower is in the second tower position, than when the tower is in the first tower position. At least one canopy is connected to the top. The at least one canopy has an extended position and a retracted position.

In an additional aspect, the top has at least one storage compartment therein adapted to receive at least a portion of the at least one canopy when the at least one canopy is in the retracted position.

In a further aspect, the tower includes a left arm having a top end connected to the top and a bottom end movably connected to a left side of the deck. The tower also includes a right arm having a top end connected to the top and a bottom end movably connected to a right side of the deck. The left and right arms are disposed such that the top is disposed at least in part laterally between the left and right arms.

In an additional aspect, the left arm is a first left arm and the right arm is a first right arm. The tower also includes a second left arm having a top end connected to the top and a bottom end movably connected to the left side of the deck. The tower also includes a second right arm having a top end connected to the top and a bottom end movably connected to the right side of the deck. The top is disposed at least in part laterally between the second left and right arms.

In an additional aspect, the top end of at least one of the second left arm and the second right arm is further from the deck and closer to the stern than the top end of a corresponding one of the first left arm and the first right arm.

In a further aspect, the boat includes an actuator operatively connected to the tower to move the tower between the first and second positions.

In yet an additional aspect, at least one of a switch, a remote control, and a lever is associated with the actuator to control the actuator.

In another aspect, the boat includes an actuator operatively connected to the at least one frame member to move the canopy between the extended and retracted positions.

In a further aspect, the tower includes a left arm having a top end pivotally connected to the top about an axis and a bottom end pivotally connected to a left side of the deck. The tower also includes a right arm having a top end pivotally connected to the top about the axis and a bottom end pivotally connected to a right side of the deck. The top of the tower is disposed at least in part laterally between the left and right arms. When the tower is in the first position, the top has an orientation. As the tower pivots between the first and second positions, the top pivots about the axis so as to maintain generally the same orientation.

In one aspect, the invention provides a boat having hull and a deck disposed on the hull. A tower is connected to the deck. The tower has a top. The top has at least one storage compartment defined therein. A canopy is connected to the top. The canopy has at least one frame member and a canvas connected to the at least one frame member. The canopy has an extended position and a retracted position, such that the canvas and the at least one frame member are disposed at least in part in the storage compartment of the top when the canopy is in the retracted position.

In an additional aspect, the at least one frame member has an end pivotally connected to the top about an axis, such that the at least one frame member pivots between the extended and retracted positions about this axis.

In yet another aspect, the at least one frame member includes a first right member having a first end and a second end. The first end of the first right member is pivotally connected to a right portion of the top. The frame also includes a second right member having a first end and a second end. The first end of the second right member is pivotally connected to the second end of the first right member. The frame member also includes a first left member having a first end and a second end. The first end of the first left member is pivotally connected to a left portion of the top. The frame member also includes a second left member having a first end and a second end. The first end of the second left member is pivotally connected to the second end of the first left member. A first distance between the first end of the first right member and the second end of the second right member is greater when the canopy is in the extended position than when the canopy is the retracted position. A second distance between the first end of the first left member and the second end of the second left member is greater when the canopy is in the extended position than when the canopy is the retracted position. A third distance between the second end of the first right member and the second end of the first left member is greater when the canopy is in the extended position than when the canopy is the retracted position.

In yet a further aspect, the boat includes an actuator operatively connected to the at least one frame member to move the canopy between the extended and retracted positions.

In yet an additional aspect, at least one of a switch, a remote control, and a lever is associated with the actuator to control the actuator.

In another aspect, the boat includes an actuator operatively connected to the tower to move the tower between the first and second positions.

In a further aspect, the canopy is a front canopy, the at least one frame member is at least one front frame member, and the canvas is a front canvas. The front canopy is connected to a front side of the top. The boat further includes a rear canopy having at least one rear frame member and a rear canvas connected to the at least one rear frame member. The rear canopy has an extended position and a retracted position. The rear canvas and the at least one rear frame member are disposed at least in part in the storage compartment of the top when the rear canopy is in the retracted position. The rear canopy is connected to a rear side of the top.

In an additional aspect, the tower includes a left arm having a top end connected to the top and a bottom end movably connected to a left side of the deck. The tower also includes a right arm having a top end connected to the top and a bottom end movably connected to a right side of the deck. The left and right arms are disposed such that the top is disposed at least in part between the left and the right arms.

In yet another aspect, the left arm is a first left arm and the right arm is a first right arm. The tower also includes a second left arm having a top end connected to the top and a bottom end movably connected to the left side of the deck. The tower also includes a second right arm having a top end connected to the top and a bottom end movably connected to the right side of the deck. The top is disposed at least in part laterally between the second left and right arms.

In yet a further aspect, the top end of at least one of the second left arm and the second right arm is further from the deck and closer to a stern than the top end of a corresponding one of the first left arm and the first right arm.

For purposes of this application, terms related to spatial orientation such as forwardly, rearwardly, left, and right, are as they would normally be understood by a driver of the boat sitting thereon in a normal driving position. Also for purposed of this application, the term "tower" comprises towers, half-towers, and ski and wakeboard towers.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a sport boat. However, it should be understood that other types of boats are contemplated, such as pontoons or catamarans for example.

Figure 1:
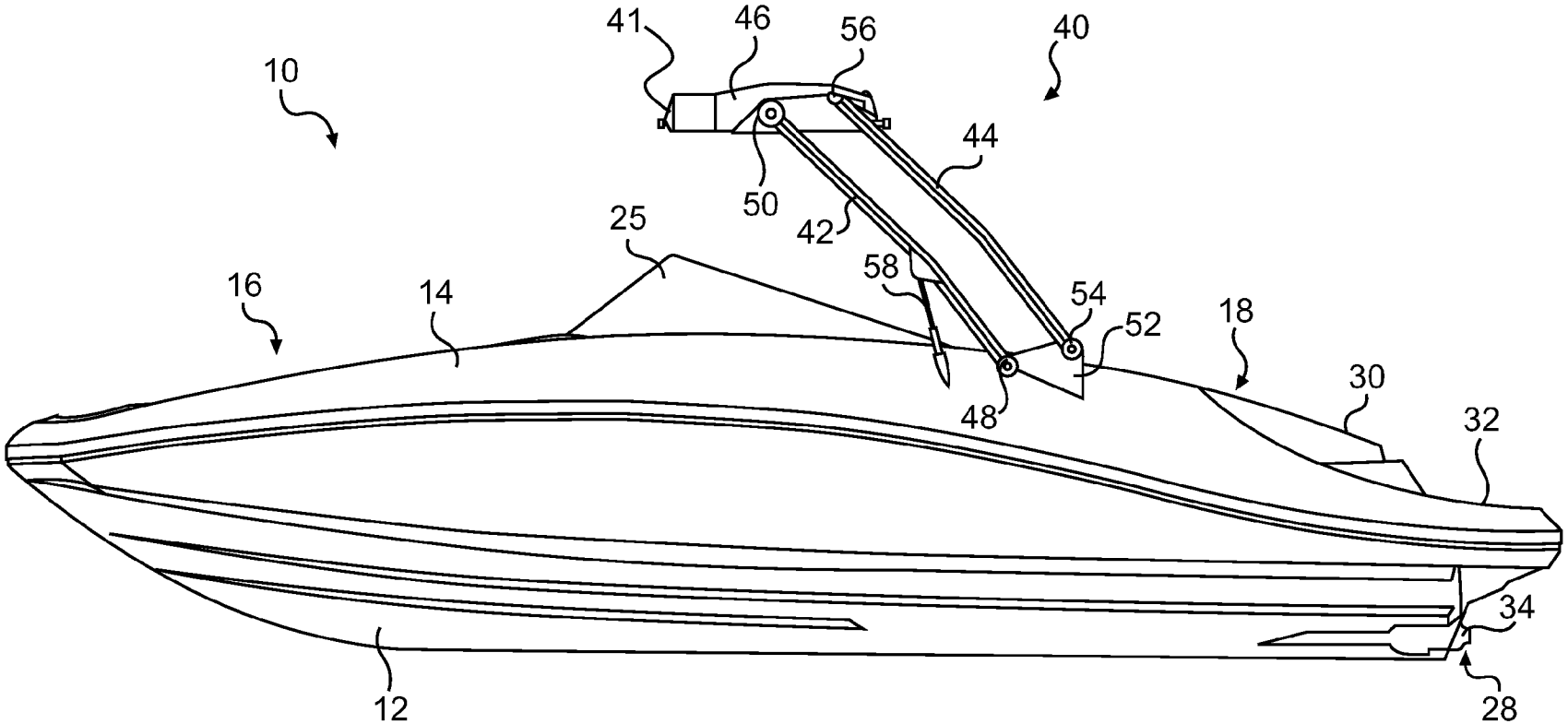
FIG. 1 is a left side elevation view of a boat according to the present invention, with a tower of the boat in its raised position and canopies in their retracted positions.
Figure 2:
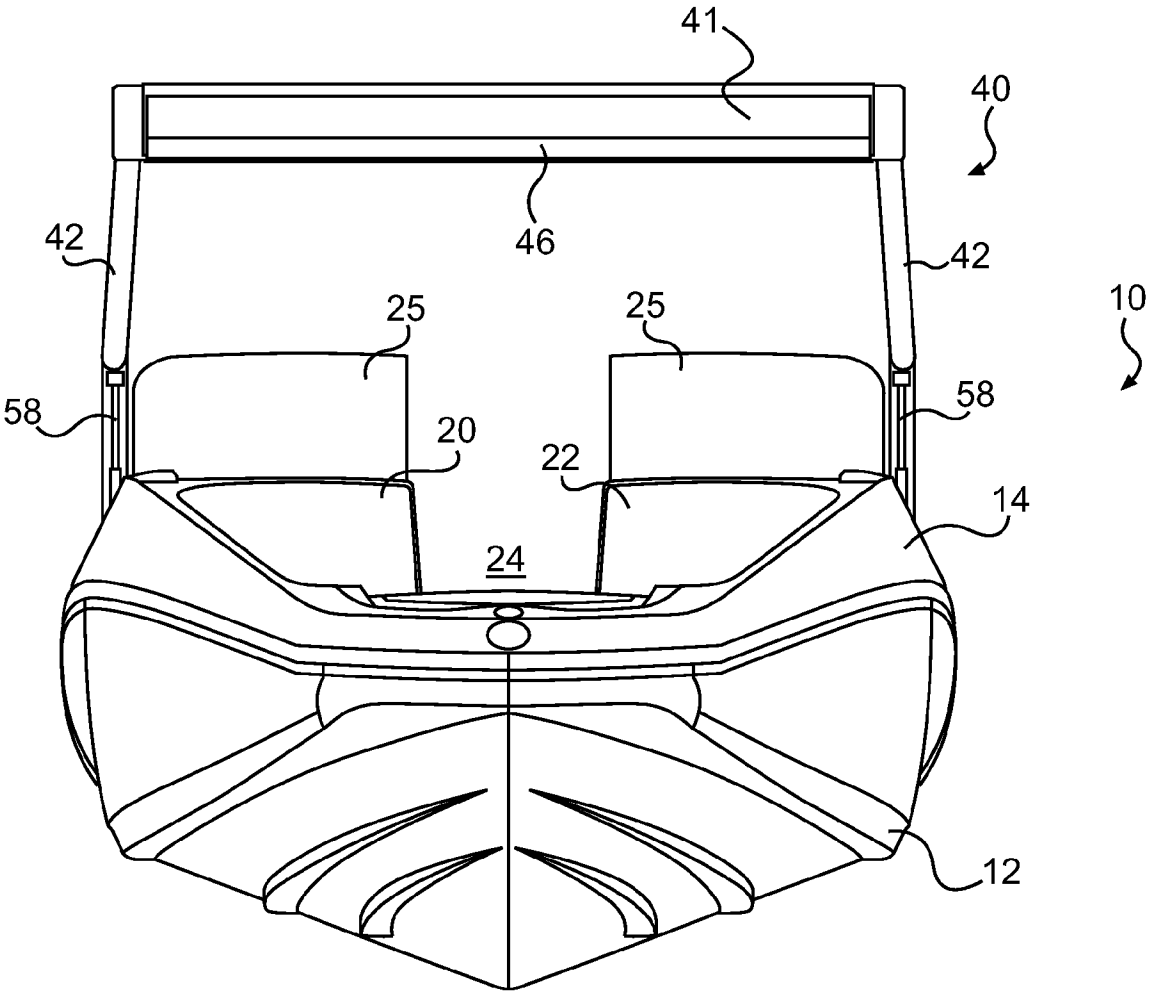
FIG. 2 is a front elevation view of the boat of FIG. 1.

The general construction of a sport boat 10 in accordance with this invention will now be described with respect to FIGS. 1 to 3. The following description relates to one way of manufacturing a sport boat. Those of ordinary skill in art of sport boats should recognize that there are other known ways of manufacturing and designing sport boats and that this invention would encompass those other known ways and designs.

The sport boat 10 has a hull 12 and a deck 14 supported by the hull 12. The deck 14 has a forward passenger area 16 and a rearward passenger area 18. A right console 20 and a left console 22 are disposed on either side of the deck 14 between the two passenger areas 16, 18. A passageway 24 disposed between the two consoles 20, 22 allows for communication between the two passenger areas 16, 18. A windshield 25 is provided at least partially on the right and left consoles 20, 22 to shield the passengers sitting in the rearward passenger area 18 from the wind when the boat 10 is in movement. The right console 20 accommodates all of the elements necessary to the driver to operate the boat 10. These include, but are not limited to: a steering assembly including a steering wheel 26, a throttle lever, and an instrument panel. The instrument panel has various dials indicating the boat speed, engine speed, fuel and oil level, and engine temperature.

At least one engine (not shown) is located between the hull 12 and the deck 14 at the back of the boat 10. The engine powers the jet propulsion system 28 of the boat 10 described in greater detail below. It is contemplated that the boat 10 could alternatively be propelled by a stern drive, an outboard engine, or an inboard engine connected to a propeller. The engine is accessible through an engine cover 30 located behind the rearward passenger area 18. The engine cover 30 can also be used as a sundeck for a passenger of the boat 10 to sunbathe on while the boat 10 is not in motion. A reboarding platform 32 is located at the back of the deck 14 for passengers to easily reboard the boat 10 from the water.

The jet propulsion system 28 pressurizes water to create thrust. The water is first scooped from under the hull 12 through an inlet (not shown), which preferably has a grate (not shown). The inlet grate prevents large rocks, weeds, and other debris from entering the jet propulsion system 28, which may damage the system or negatively affect performance. Water flows from the inlet 28 through a water intake ramp (not shown). From the intake ramp, water enters a jet pump (not shown). Once the water leaves the jet pump, it goes through a venturi (not shown) that is connected to the rearward end of the jet pump. A steering nozzle 34 is rotationally mounted relative to the venturi to redirect the jet of water from the venturi and, as a result, steer the boat 10. The steering nozzle 34 is operatively connected to the steering wheel 26 via a push-pull cable (not shown) such that when the steering wheel 26 is turned, the steering nozzle 34 pivots. It is contemplated that the steering nozzle 34 could be connected to the steering wheel 26 via an electronic drive-by-wire system.

The jet propulsion system 28 is provided with a reverse gate (not shown) which can be used to redirect the jet of water being expelled by the steering nozzle 34 towards a front of the boat 10 and, as a result, cause the boat 10 to move in a reverse direction.

The boat 10 has a tower 40 movably connected to the deck 14. The tower 40 includes left and right front arms 42, left and right rear arms 44 disposed rearwardly of the front arms 42, and a rigid top 46 disposed between the upper ends of the arms 42, 44. Each of the arms 42, 44 is made of two sections connected to each other at an angle to form a bend near the center of each of the arms 42, 44. However it is contemplated that each of the arms 42, 44 could be made of a single straight section or of more than two sections. The rigid top 46 provides a shaded area on the deck 14.

Figure 3:
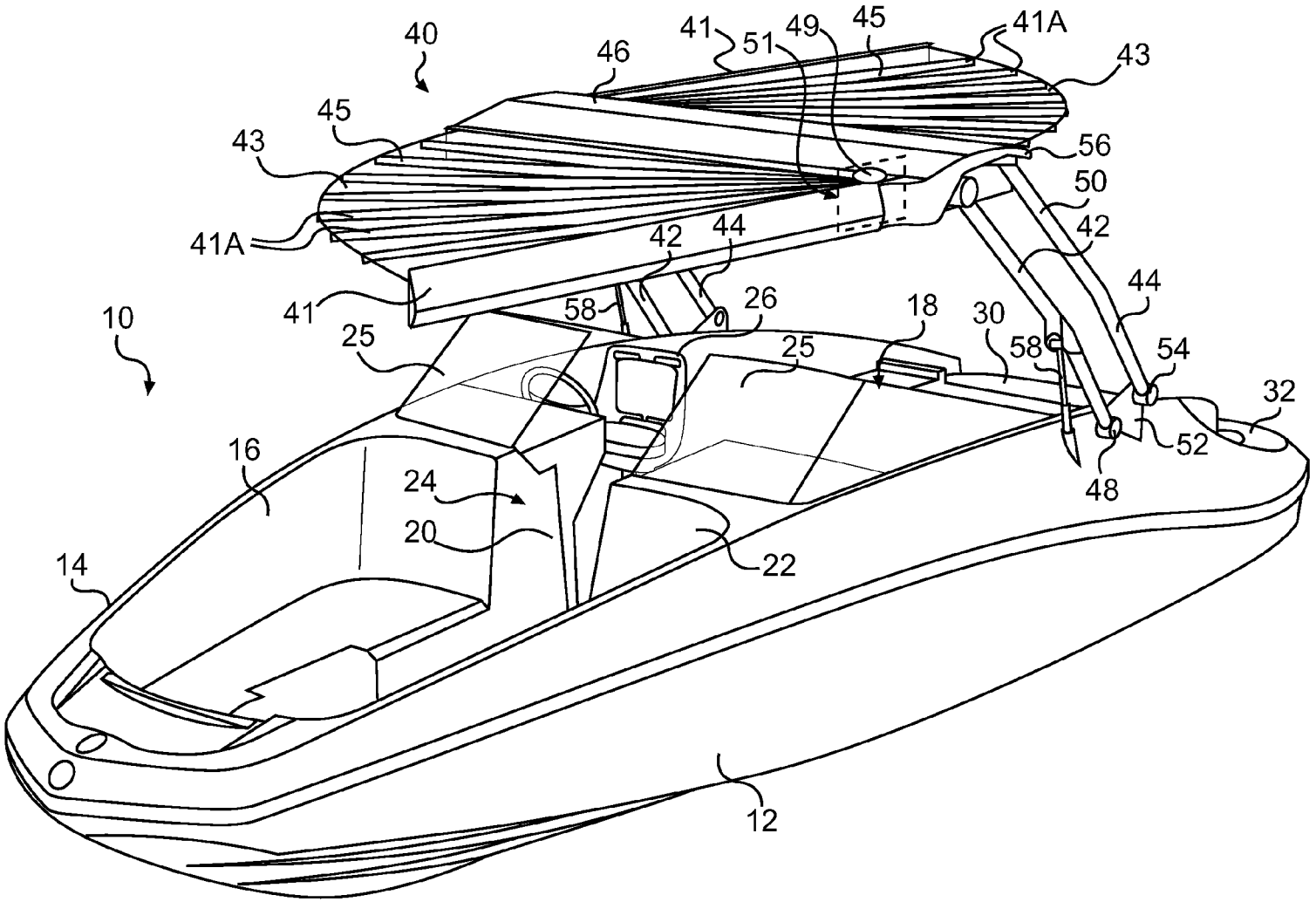
FIG. 3 is a perspective view, taken from a front, left side, of the boat of FIG. 1, with the tower in its raised position and the canopies in their extended positions.
Figure 4:
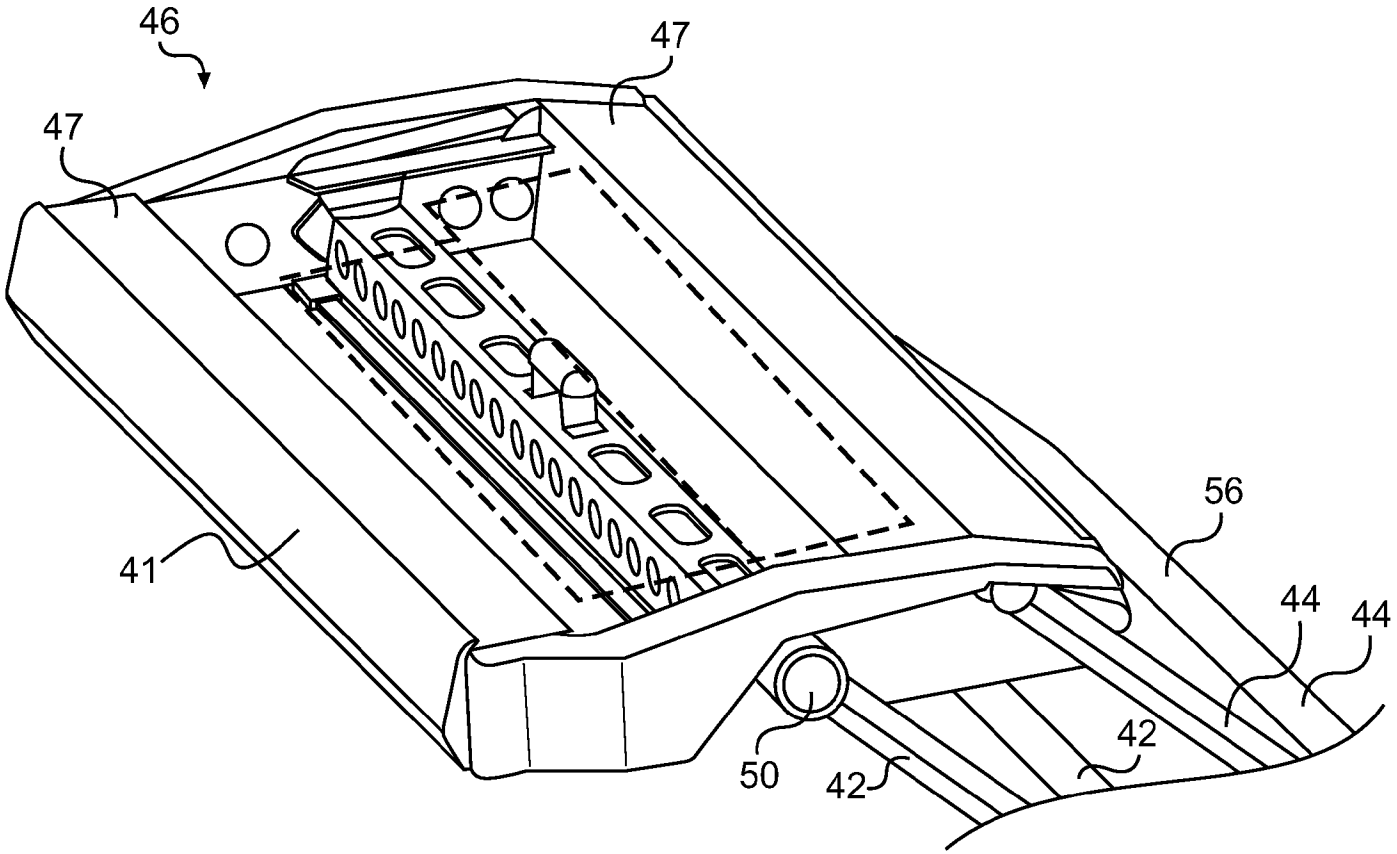
FIG. 4 is a perspective view, taken from a front, left side, of a top of the tower of the boat of FIG. 1, with a lid of the top removed and the canopies in their retracted positions.

As can be seen in FIG. 3, two retractable canopies 45 are connected to the rigid top 46. One canopy 45 is connected to a left portion of a front side of the rigid top 46 and the other canopy 45 is connected to a right portion of a back side of the rigid top 46. The canopies 45 are fan-type canopies that can be extended as shown to provide increased shading on the deck 14. When they are not in use, the canopies 45 are retracted inside storage compartments 47 (FIG. 4) formed in the rigid top 46. The canopies 45 will be described in greater detail below. It is contemplated that one canopy 45, or more canopies 45 could be provided. It is contemplated that other types of canopies 45 could alternatively be provided.

Figure 5:
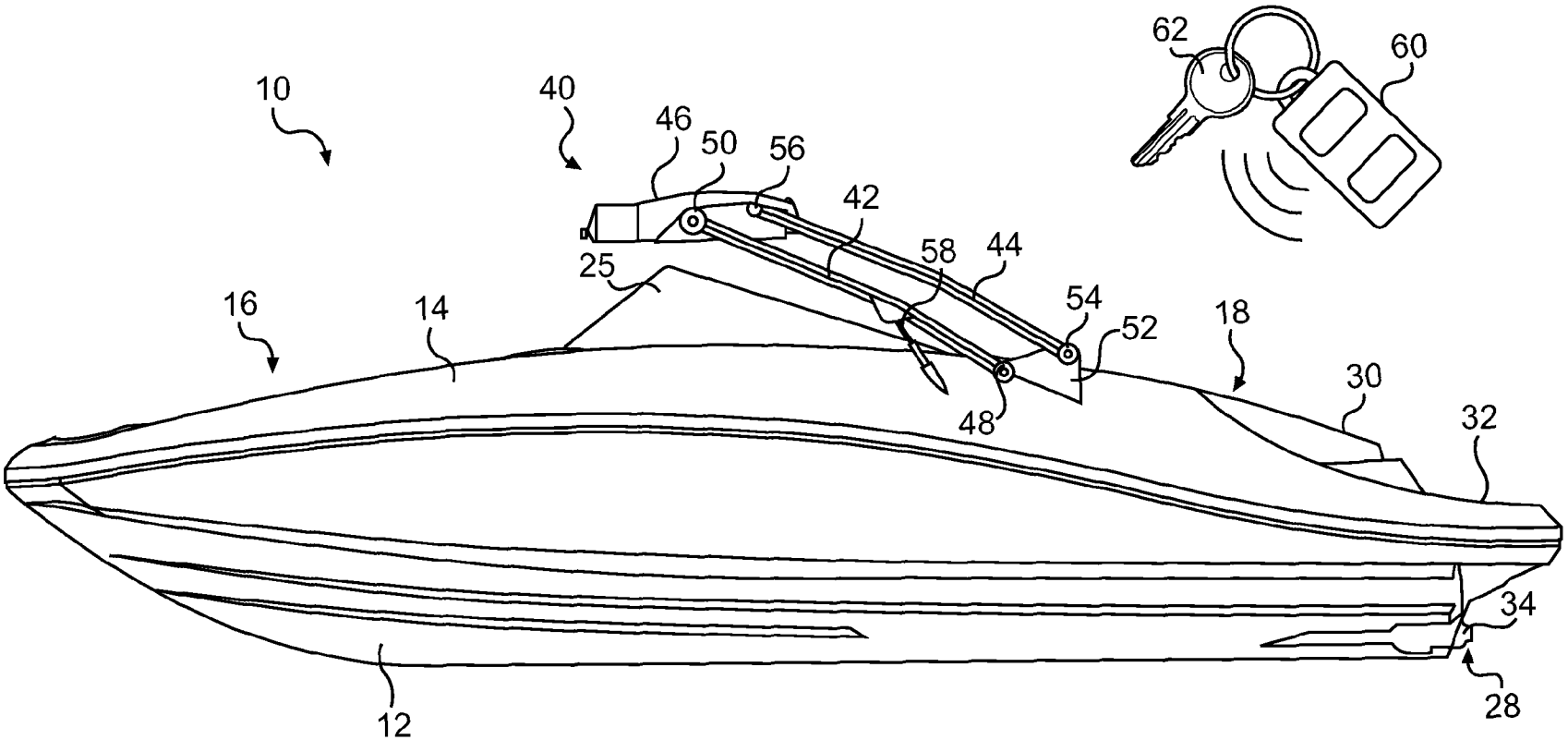
FIG. 5 is a left side elevation view of the boat of FIG. 1, with the tower in a lowered position.
Figure 6:
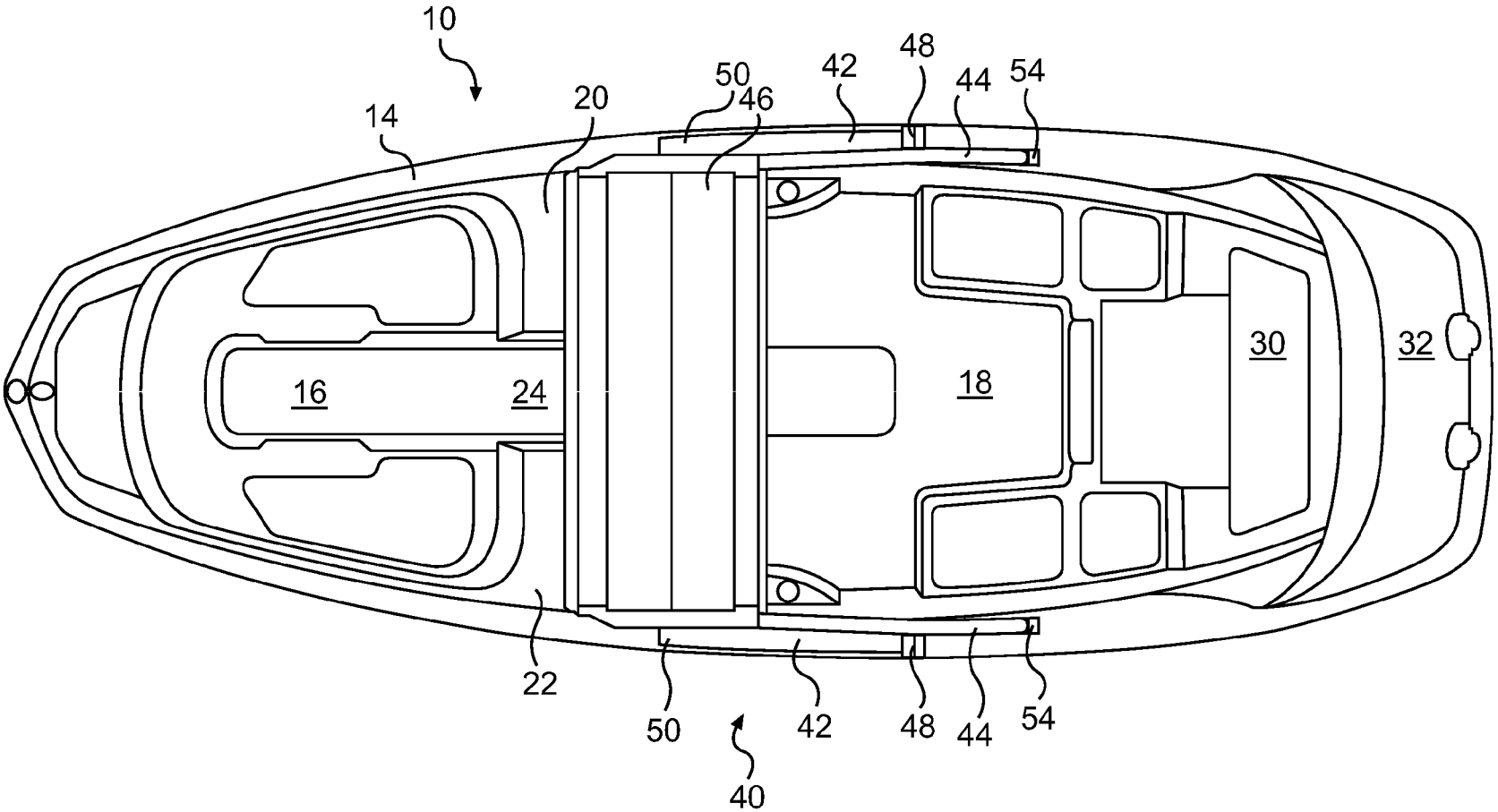
FIG. 6 is a top plan view of the boat of FIG. 1, with the tower in a lowered position and the canopies in their retracted positions.

The lower end of each front arm 42 is connected to the deck 14 via a pivot 48. The upper end of each front arm 42 is connected to the top 46 via a pivot 50 recessed in the side of the top 46. The lower end of each rear arm 44 is connected to a bracket 52 via a pivot 54 disposed rearwardly and upwardly of the pivot 48. The bracket 52 is mounted to the deck 14. The upper end of each rear arm 44 is connected to the top 46 via a pivot 56 recessed in the side of the top 46. The pivot 56 is disposed rearwardly and upwardly from the pivot 50. As can be seen, each of the arms 42, 44 has a bend in it. As the arms 42, 44 pivot about the pivots 48, 54, the top 46 moves in an arc and pivots about the pivots 50, 56 so as to maintain a generally horizontal orientation regardless of the position of the arms 42, 44. By pivoting the arms 42, 44, the area to which the top 46 provides shading can be changed as will be described in greater detail below, and the top 46 can also be moved to a lowered position shown in FIGS. 5 and 6 in order to prepare the boat 10 for storage or transportation.

Left and right linear actuators 58 are provided to pivot the tower 40. Each linear actuator 58 has one end connected to a corresponding one of the left and right front arms 42 and another end connected to the deck 14. The linear actuators 58 preferably each consist of a worm gear connected to a rotary electric motor and of a rod associated with the worm gear that translates in response to the rotation of the worm gear. Alternatively, the linear actuators 58 could be hydraulic or pneumatic cylinders. It is contemplated that the linear actuators 58 could be connected to the rear arms 44 instead of the front arms 42. It is also contemplated that the linear actuators 58 could be replaced with one or more rotary actuators operatively connected to one or more of the pivots 48, 54. It is contemplated that only one or more than two linear actuators 58 could be provided. Finally, it is also contemplated that no actuators could be provided and the tower 40 could be pivoted manually. In such a case, a mechanism would be provided to allow the tower 40 to be locked into position.

Figure 7:
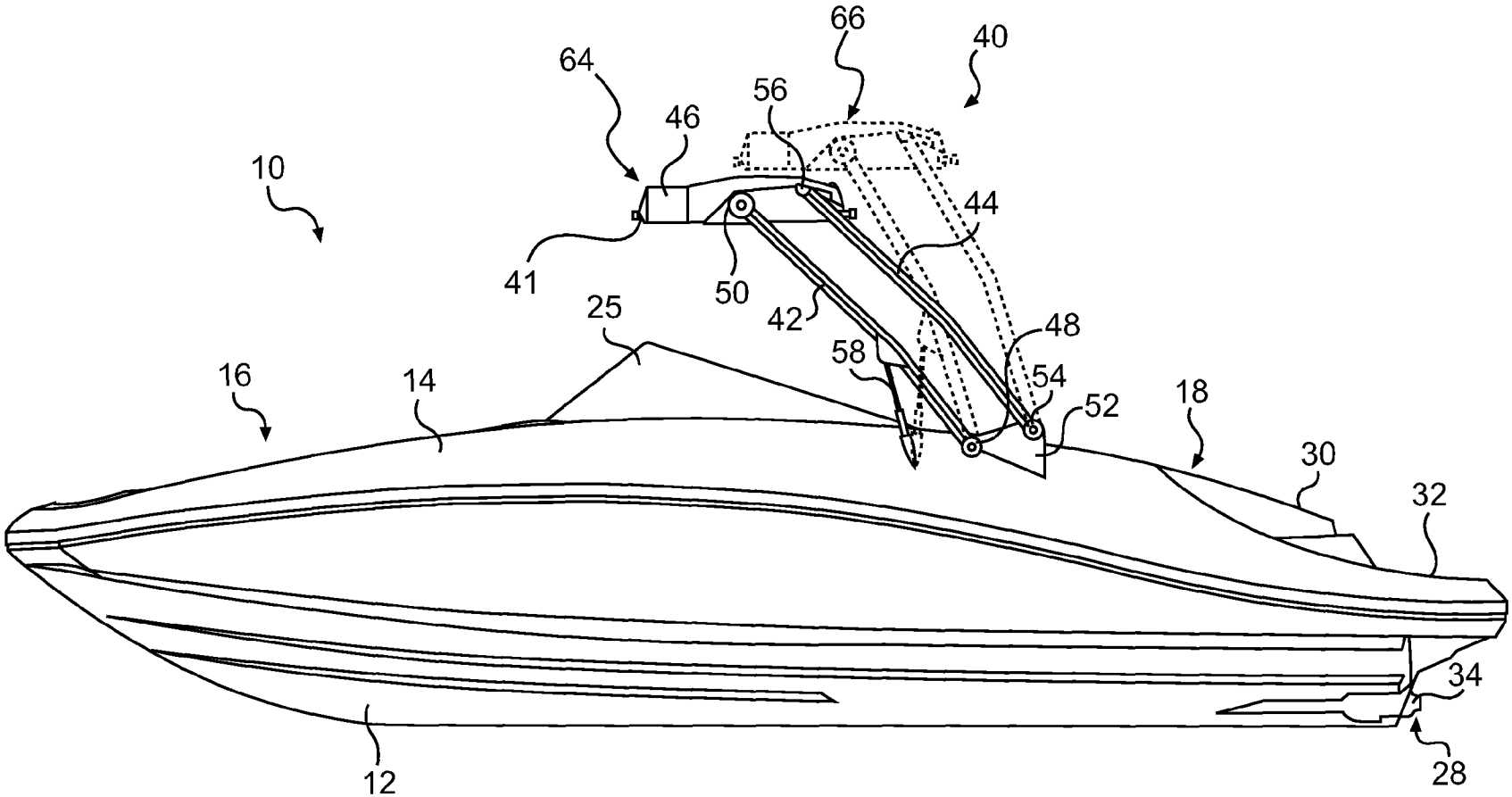
FIG. 7 is a left side elevation view of the boat of FIG. 1, illustrating various positions of the tower and the canopies in their retracted positions.

As can be seen in FIG. 7, pivoting of the arms 42 and 44 moves the tower 40 from a first position 64 to a second position 66 (shown in dotted lines) such that the area of the deck 14 that is covered by the rigid top 46 is changed. When the tower 40 is in the first position 64 or in the second position 66, distance between the rigid top 46 and the deck 14 is sufficient to allow a user of the boat 10 to easily circulate under the rigid top 46. The canopies 45 may be retracted or partly or fully extended when the tower 40 moves between the first position 64 and the second position 66. Only two positions of the tower 40 are shown in FIG. 7, however, it should be understood that the tower 40 has a plurality of positions between the lowered position (FIGS. 5 and 6), the second position 66, and has other positions beyond the second position 66 towards the rear of the boat 10. It is contemplated that a stopper (not shown) could be provided to prevent the tower 40 from pivoting towards the rear of the boat 10 beyond a predetermined position.

A remote control 60 (FIG. 5) is provided which can be used by a user of the boat 10 to wirelessly control the linear actuators 58, and therefore the position of the tower 40. As can be seen, the remote control 60 is incorporated into a key chain used to hold the key 62 of the boat 10. Alternatively, switches or lever provided on the deck 14, such as on one of the consoles 20, 22, could be used to control the linear actuators 58.

The canopies 45 will now be described in greater detail with respect to FIG. 3. Only one of the two canopies 45 will be described below as the two canopies 45 are substantially the same and operate in substantially the same manner. The fan-type canopy 45 has a canvas 43 which is securely attached to a frame member 41 and to a plurality of intermediate support members 41*a*. It is contemplated that the canvas 43 could be selectively attached to at least one of the frame member 41 and the intermediate support members 41*a*. The frame member 41 is connected to the rigid top 46 via a pivot 49.

An actuator 51 is provided to pivot the frame member 41 about an axis passing through the pivot 49, so as to extend or retract the canopy 45. The actuator 51 is connected to the frame member 41 and to the top 46 at the pivot 49. The actuator 51 is a rotary actuator, which preferably consists of a gear train connected to a rotary electric motor. It is contemplated that the rotary actuator could be replaced with one or more linear actuators operatively connected to the frame member 41 and to the top 46. It is also contemplated that more than one rotary actuator could be provided. Finally, it is also contemplated that no actuators could be provided and that the frame member 41 could be pivoted manually. In such a case, a mechanism would be provided to allow the frame member 41 to be locked into position. The remote control 60 (FIG. 5) is used to wirelessly control the rotary actuator, and therefore the extension and the retraction of the canopy 45. Alternatively or additionally, switches or levers provided on the deck 14 could control the rotary actuator.

The intermediate support members 41*a* are connected to the rigid top 46 via the pivot 49. When the canopy 45 is in an extended position, the intermediate support members 41*a* support the canvas 43, such that the canvas 43 is in tension, and prevent the sagging thereof. It is contemplated that the intermediate support members 41*a* alternatively may be connected to the frame member 41. It is also contemplated that the intermediate support members 41*a* could alternatively be connected to the rigid top 46 at point other than the pivot 49.

Figure 8:
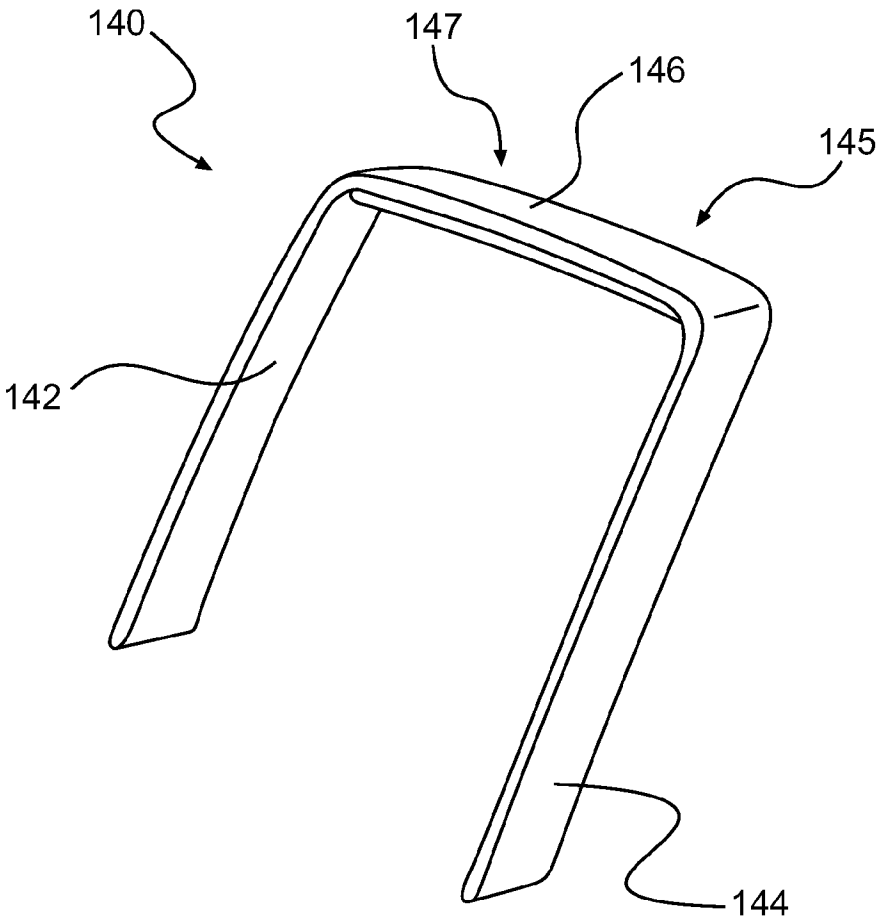
FIG. 8 is a perspective view, taken from a rear, right side of an alternative embodiment of a tower to be used on the boat of FIG. 1.

An alternative embodiment of the tower 40 (tower 140) to be also used with the boat 10 is shown in FIG. 8. The tower 140 has a left arm 142, a right arm 144, and a rigid top 146 disposed laterally between the left arm 142 and right arm 144. The left arm 142 is rigidly connected at its lower end to a left side of a deck 14 and the right arm 144 is rigidly connected at its lower end to a right side of the deck 14. It is contemplated that the arms of the tower 140 could be movably connected to the deck 14, so as to be able to pivot about an axis passing through their connection points, or to be able to move rearwardly or forwardly along the sides of the deck 14 on rails for example. It is contemplated that should the tower 140 be movably connected to the deck 14, an actuator would be operatively connected to the tower 140 or the tower 140 would be moved manually in order to pivot or move the tower 140 along the sides of the deck 14.

Figure 9:
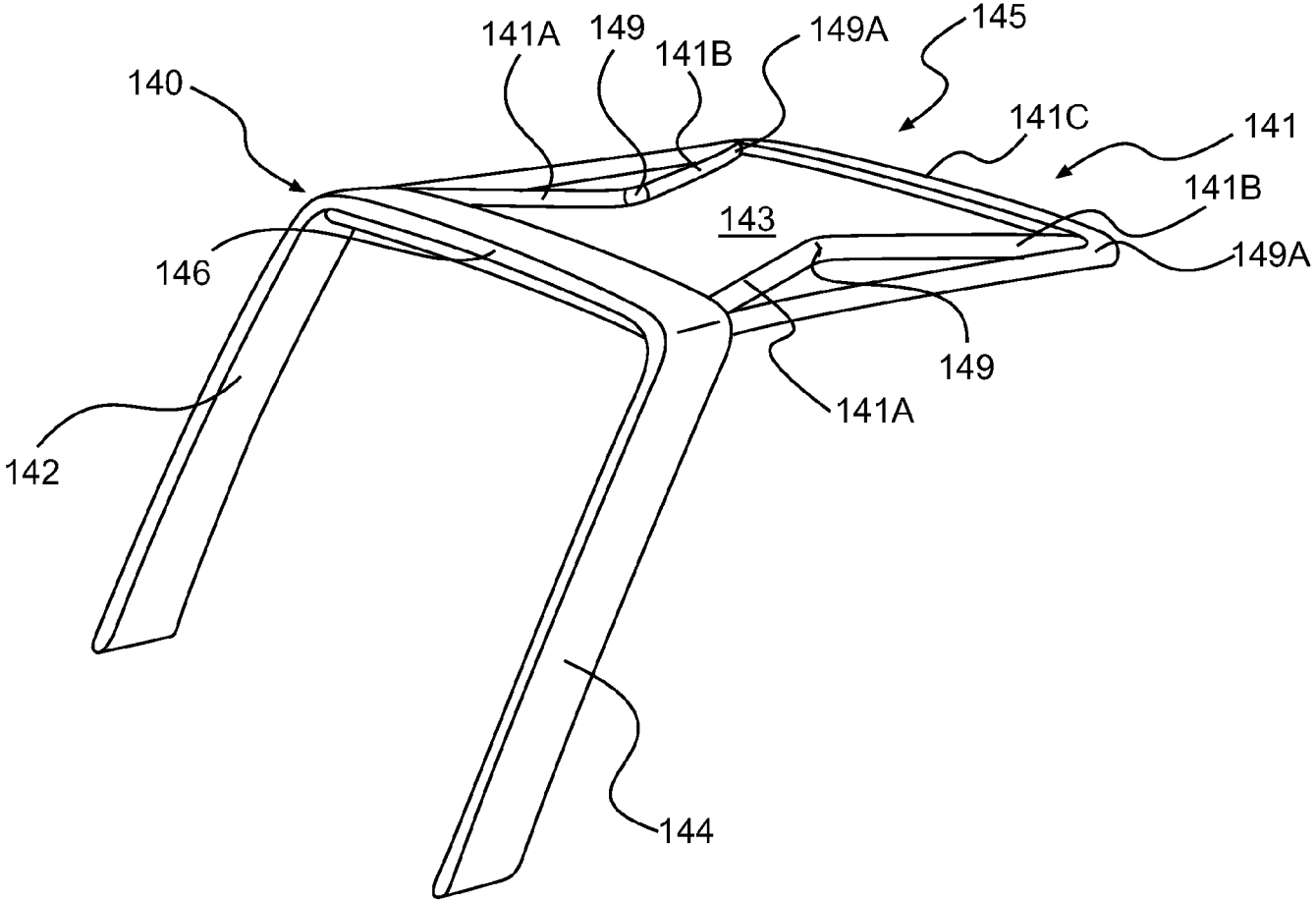
FIG. 9 is a perspective view, taken from a rear, right side of the tower of FIG. 8 with a canopy illustrated in its extended position.

The tower 140 has a canopy 145 shown in FIG. 9. The canopy 145 is connected to a front side of the rigid top 146 of the tower 140. The canopy 145 can be extended as shown in FIG. 9 or retracted into a storage compartment 147 located inside the rigid top 146 as shown in FIG. 8. The canopy 145 has a frame 141 and a canvas 143 securely attached to the frame 141. It is contemplated that the canvas 143 could be selectively attached to the frame 141.

The frame 141 has left and right rear frame members 141*a* and left and right front frame members 141*b*. Each rear end of the left and right rear frame members 141*a* is attached via a pivot (not shown) to the rigid top 146. Each front end of the left and right rear frame members 141*a* is attached via a pivot 149 to a corresponding rear end of each of the front frame members 141*b*. Each front end of the front frame members 141*b* is attached via a pivot 149*a* to a forwardmost frame member 141*c*, which is disposed laterally between the left and right front frame members 141*b*.

Rotary actuators (not shown) are provided to extend and to retract the canopy 145. Each rear frame member 141*a* is provided with a rotary actuator between a rear end thereof and the rigid top 146 at the pivot therebetween. Each frame member 141*a* is provided with another rotary actuator between the front end thereof and a rear end of the corresponding front frame member 141*b* at the pivot 149. It is contemplated that the actuators disposed between the frame members 141*a* and the frame members 141*b* could be omitted. Each rotary actuator preferably consists of a gear train connected to a rotary electric motor. It is contemplated that the rotary actuator could be replaced with one or more linear actuators operatively connected between the frame member 141*c* and to the top 146. Finally, it is also contemplated that no actuators could be provided and the canopy 145 could be extended or retracted manually. In such a case, a mechanism would be provided to allow the frame 141 to be locked into position. As in the above embodiment, a remote control is provided which can be used by a user of the boat to wirelessly control the rotary actuators, and therefore the extension and the retraction of the canopy 145. Alternatively or additionally, as in the above embodiment, switches or levers provided on the deck could control the rotary actuators.

Figure 10:
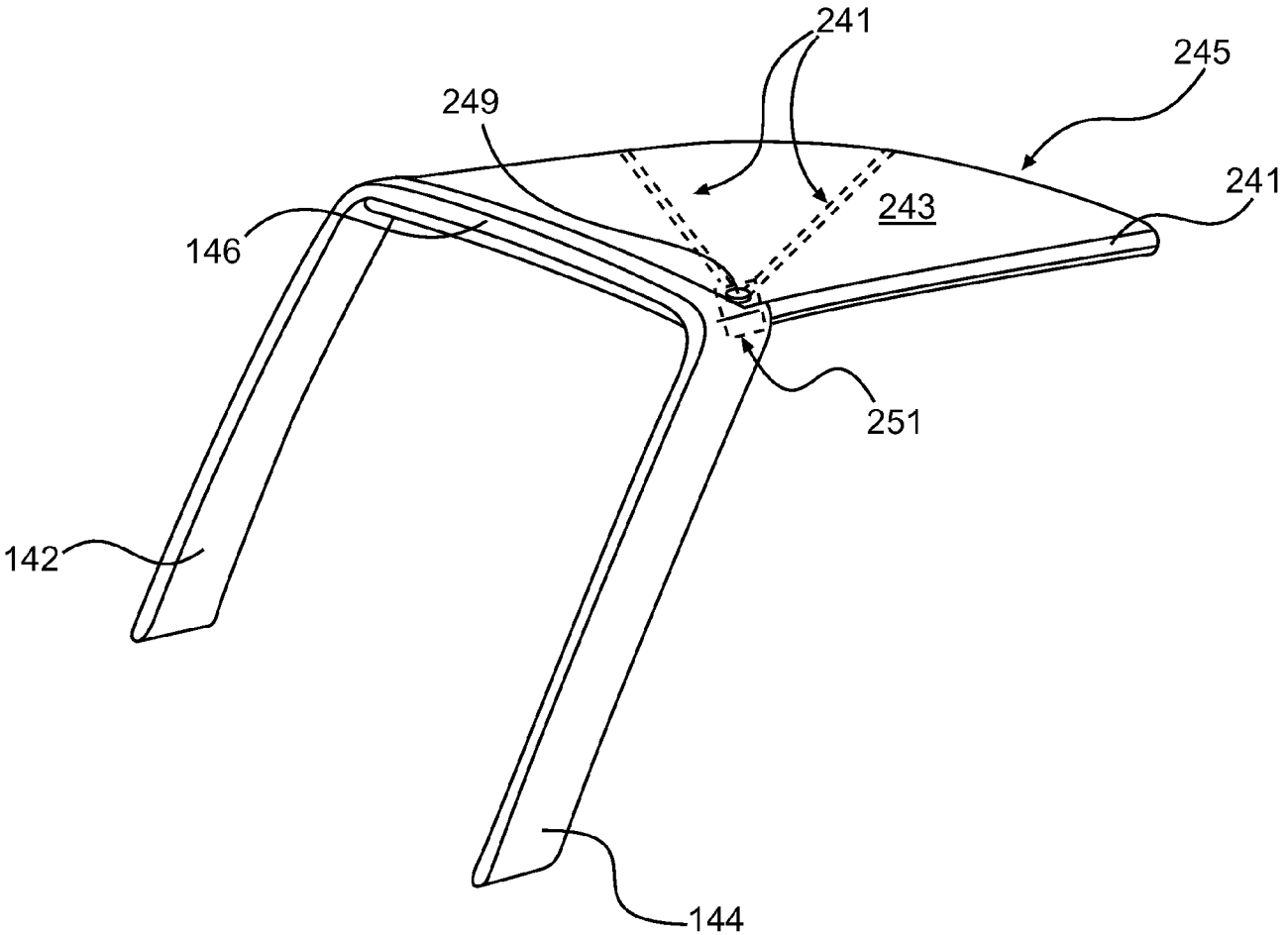
FIG. 10 is a perspective view, taken from a rear, right side of the tower of FIG. 8 with an alternative embodiment of a canopy illustrated in its extended position.

An alternative embodiment of the canopy 145 (canopy 245) is shown in FIG. 10. The canopy 245 has three frame members 241, with a canvas 243 securely attached thereto, attached to the rigid top 146 at a pivot 249. The canvas 243 covers two of the three frame members 241. It is contemplated that the canvas 243 could be selectively attached to at least one of the three frame members 241. A rotary actuator 251 is attached to each of the three frame members 241 and to the rigid top 246 at the pivot 249, in order to extend and retract the canopy 245. In the retracted position, the canopy 245 is stored in the rigid top 146 as shown in FIG. 8. As in the above embodiments, a remote control is provided which can be used by a user of the boat to wirelessly control the rotary actuators, and therefore the extension and the retraction of the canopy 145. Alternatively or additionally, as in the above embodiments, switches or levers provided on the deck could control the rotary actuators.

Figure 11:
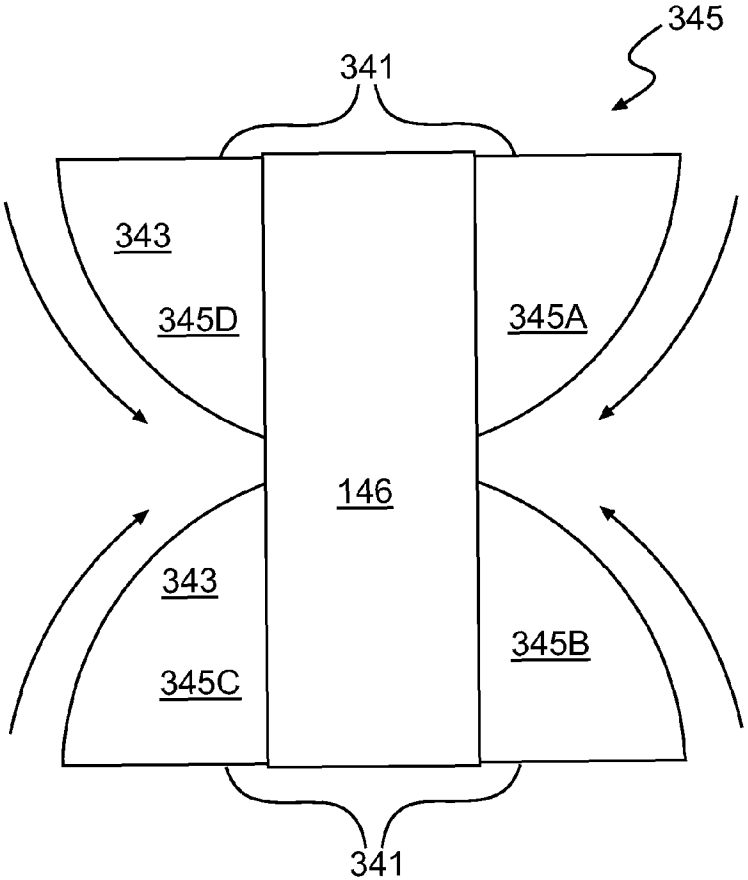
FIG. 11 is a schematic top plan view of the tower of FIG. 8, with an alternative canopy arrangement having four canopies illustrated in their extended positions.

An alternative canopy arrangement 345 to be used with the tower 140 is shown in FIG. 11. The canopy arrangement 345 consists of four canopies 345*a*, 345*b*, 345*c*, and 345*d* connected to the rigid top 146. Each of the four canopies 345*a*, 345*b*, 345*c*, and 345*d* has one frame member 341 and a canvas 343. The frame member 341 of the canopy 345*a* is pivotally attached to a left portion of the front side of the rigid top 146. The frame member 341 of the canopy 345*b* is pivotally attached to a right portion of the front side of the rigid top 146. The frame member 341 of the canopy 345*c* is pivotally attached to a right portion of the rear side of the rigid top 146. The frame member 341 of the canopy 345*d* is pivotally attached to a left portion of the rear side of the rigid top 146. The canopies 345*a*, 345*b*, 345*c*, and 345*d* can be retracted inside the rigid top 146 in the direction indicated by the arrows. As in the above embodiments, rotary actuators are connected to the pivots connecting each of the frame members 341 of the four canopies 345*a*, 345*b*, 345*c*, and 345*d* to the rigid top 146.

Figure 12:
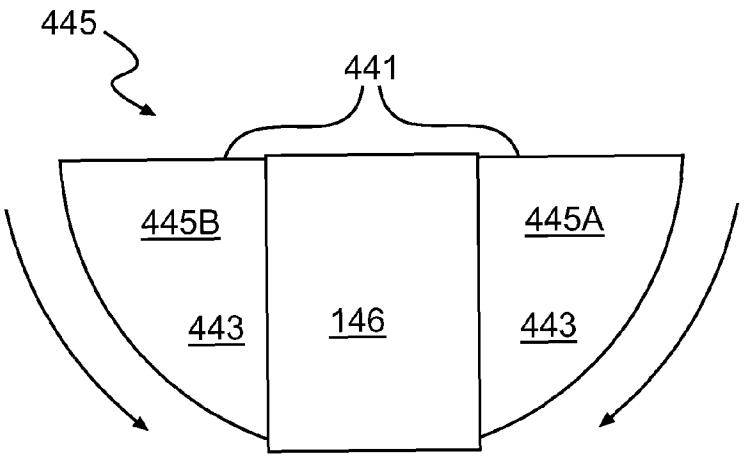
FIG. 12 is a schematic top plan view of the tower of FIG. 8, with another alternative canopy arrangement having two canopies illustrated in their extended positions.

Another alternative canopy arrangement 445 to be used with the tower 140 is shown in FIG. 12. The canopy arrangement 445 consists of two canopies 445*a*, and 445*b*, connected to the font and rear sides of the rigid top 146 respectfully. Each of the two canopies 445*a*, and 445*b* has one frame member 441 and a canvas 443. The frame member 441 of the canopy 445*a* is pivotally attached to a left portion of the front side of the rigid top 146. The frame member 441 of the canopy 445*b* is pivotally attached to a left portion of the rear side of the rigid top 146. It is contemplated that the frame members 441 of the canopies 445*a* and 445*b* may alternatively be pivotally attached to the right portions of the front and rear sides of the rigid top 146 respectively. The canopies 445*a*, and 445*b* can be retracted inside the rigid top 146 in the direction indicated by the arrows. As in the above embodiments, rotary actuators are connected to the pivots connecting each of the frame members 441 of the two canopies 445*a*, and 445*b* to the rigid top 146.

Figure 13:
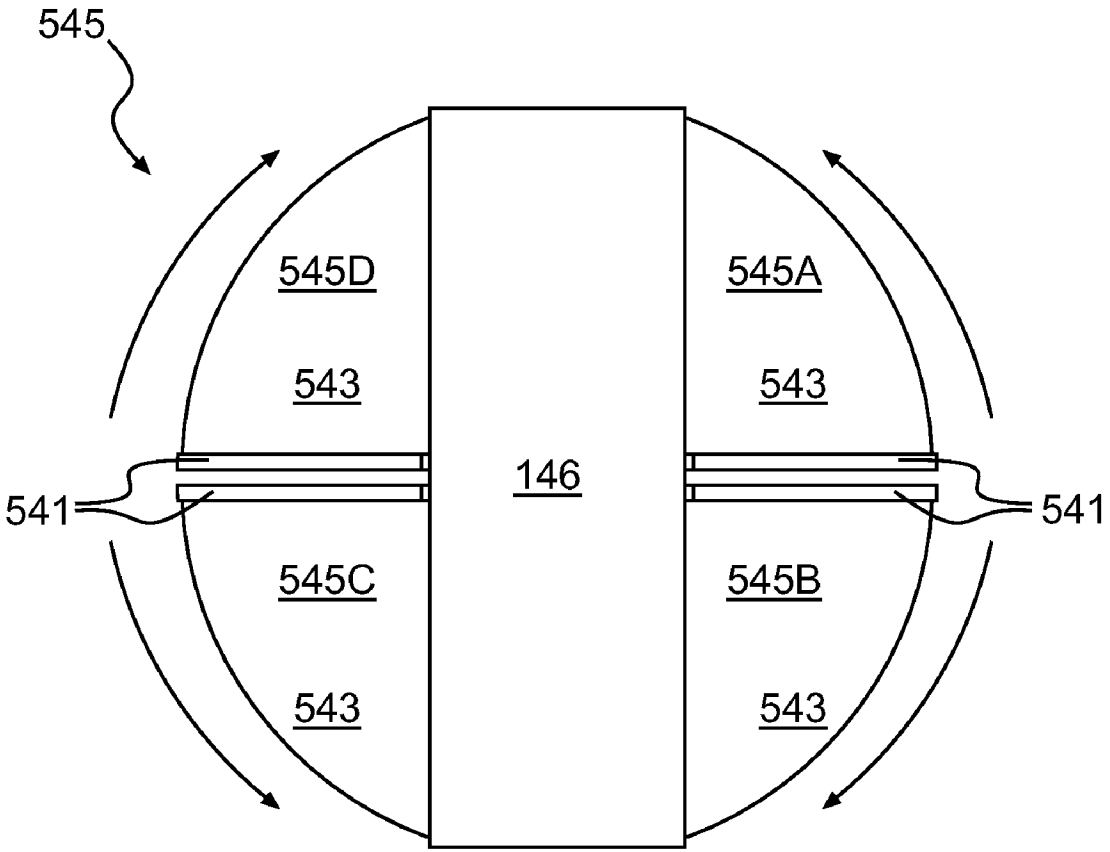
FIG. 13 is a schematic top plan view of the tower of FIG. 8, with yet another alternative canopy arrangement having two canopies illustrated in their extended positions.

A further alternative canopy arrangement 545 to be used with the tower 140 is shown in FIG. 13. The canopy arrangement 545 consists of four canopies 545*a*, 545*b*, 545*c*, and 545*d* connected to the rigid top 146. Each of the four canopies 545*a*, 545*b*, 545*c*, and 545*d* has one frame member 541 and a canvas 543. The frame members 541 of the canopies 545*a* and 545*b* are pivotally attached to a center portion of the front side of the rigid top 146. The frame members 541 of the canopies 545*c* and 545*d* are pivotally attached to a center portion of the rear side of the rigid top 146. The canopies 545*a*, 545*b*, 545*c*, and 545*d* can be retracted inside the rigid top 146 in the direction indicated by the arrows. As in the above embodiments, rotary actuators are connected to the pivots connecting each of the frame members 541 of the four canopies 545*a*, 545*b*, 545*c*, and 545*d* to the rigid top 146.

It is contemplated that the canopy arrangements shown in FIGS. 9 to 13 could also be used with the tower 40.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A boat comprising:

a hull, the hull having a bow and a stern;

a deck disposed on the hull;

a tower movably connected to the deck, the tower having:

a top;

a left arm having a top end pivotally connected to the top about an axis and a bottom end pivotally connected to a left side of the deck; and a right arm having a top end pivotally connected to the top about the axis and a bottom end pivotally connected to a right side of the deck;

the top being disposed at least in part laterally between the left and right arms, the tower being movable between a first tower position and a second tower position, the top being closer to the bow when the tower is in the second tower position than when the tower is in the first tower position, the top having an orientation when the tower is in the first position, and the top pivoting about the axis so as to maintain generally the same orientation as the tower pivots between the first and second positions; and at least one canopy connected to the top, the at least one canopy having an extended position and a retracted position.

2. The boat of claim 1, wherein the top defines at least one storage compartment therein adapted to receive at least a portion of the at least one canopy when the at least one canopy is in the retracted position.

3. The boat of claim 1, wherein the left arm is a first left arm and the right arm is a first right arm; and wherein the tower further includes:

a second left arm having a top end connected to the top and a bottom end movably connected to the left side of the deck; and a second right arm having a top end connected to the top and a bottom end movably connected to the right side of the deck;

wherein the top is disposed at least in part laterally between the second left and right arms.

4. The boat of claim 3, wherein the top end of at least one of the second left arm and the second right arm is further from the deck and closer to the stern than the top end of a corresponding one of the first left arm and the first right arm.

5. The boat of claim 1, further comprising an actuator operatively connected to the tower to move the tower between the first and second positions.

6. The boat of claim 5, further comprising at least one of a switch, a remote control, and a lever associated with the actuator to control the actuator.

7. The boat of claim 1, further comprising an actuator operatively connected to the at least one frame member to move the canopy between the extended and retracted positions.

8. A boat comprising:

a hull;

a deck disposed on the hull;

a tower connected to the deck, the tower having a top, the top having a generally horizontal orientation, the top having at least one storage compartment defined therein; and a canopy connected to the top, the canopy having at least one frame member and a canvas connected to the at least one frame member, the canopy having an extended position and a retracted position, the canvas and the at least one frame member being disposed at least in part in the storage compartment of the top when the canopy is in the retracted position, and the canopy having generally the same generally horizontal orientation as the top when the canopy is in the extended position, the at least one frame member including:

a first right member having a first end and a second end, the first end of the first right member being pivotally connected to a right portion of the top;

a second right member having a first end and a second end, the first end of the second right member being pivotally connected to the second end of the first right member;

a first left member having a first end and a second end, the first end of the first left member being pivotally connected to a left portion of the top; and a second left member having a first end and a second end, the first end of the second left member being pivotally connected to the second end of the first left member;

wherein a first distance between the first end of the first right member and the second end of the second right member being greater when the canopy is in the extended position than when the canopy is the retracted position;

wherein a second distance between the first end of the first left member and the second end of the second left member being greater when the canopy is in the extended position than when the canopy is the retracted position; and wherein a third distance between the second end of the first right member and the second end of the first left member being greater when the canopy is in the extended position than when the canopy is the retracted position.

9. The boat of claim 8, wherein the at least one frame member has an end pivotally connected to the top about an axis;

wherein the at least one frame member pivots between the extended and retracted positions.

10. The boat of claim 8, further comprising an actuator operatively connected to the at least one frame member to move the canopy between the extended and retracted positions.

11. The boat of claim 10, further comprising at least one of a switch, a remote control, and a lever associated with the actuator to control the actuator.

12. The boat of claim 8, further comprising an actuator operatively connected to the tower to move the tower between first and second tower positions.

13. The boat of claim 8, wherein the canopy is a front canopy, the at least one frame member is at least one front frame member, and the canvas is a front canvas;

wherein the front canopy is connected to a front side of the top; and further comprising a rear canopy having at least one rear frame member and a rear canvas connected to the at least one rear frame member, the rear canopy having an extended position and a retracted position, the rear canvas and the at least one rear frame member being disposed at least in part in the storage compartment of the top when the rear canopy is in the retracted position;

wherein the rear canopy is connected to a rear side of the top.

14. A boat comprising:

a hull;

a deck disposed on the hull;

a tower connected to the deck, the tower having:

a top, the top having a generally horizontal orientation, the top having at least one storage compartment defined therein;

a first left arm having a top end connected to the top and a bottom end movably connected to a left side of the deck;

a first right arm having a top end connected to the top and a bottom end movably connected to a right side of the deck;

a second left arm having a top end connected to the top and a bottom end movably connected to the left side of the deck; and a second right arm having a top end connected to the top and a bottom end movably connected to the right side of the deck, the top being disposed at least in part between the first left arm and right arms, the top is disposed at least in part laterally between the second left and right arms, the top end of at least one of the second left arm and the second right arm being further from the deck and closer to a stern than the top end of a corresponding one of the first left arm and the first right arm, and a canopy connected to the top, the canopy having at least one frame member and a canvas connected to the at least one frame member, the canopy having an extended position and a retracted position, the canvas and the at least one frame member being disposed at least in part in the storage compartment of the top when the canopy is in the retracted position, and the canopy having generally the same generally horizontal orientation as the top when the canopy is in the extended position.

15. The boat of claim 14, wherein the at least one frame member has an end pivotally connected to the top about an axis;

wherein the at least one frame member pivots between the extended and retracted positions.

16. The boat of claim 14, further comprising an actuator operatively connected to the at least one frame member to move the canopy between the extended and retracted positions.

17. The boat of claim 16, further comprising at least one of a switch, a remote control, and a lever associated with the actuator to control the actuator.

18. The boat of claim 14, further comprising an actuator operatively connected to the tower to move the tower between first and second tower positions.

19. The boat of claim 14, wherein the canopy is a front canopy, the at least one frame member is at least one front frame member, and the canvas is a front canvas;

wherein the front canopy is connected to a front side of the top; and further comprising a rear canopy having at least one rear frame member and a rear canvas connected to the at least one rear frame member, the rear canopy having an extended position and a retracted position, the rear canvas and the at least one rear frame member being disposed at least in part in the storage compartment of the top when the rear canopy is in the retracted position;

wherein the rear canopy is connected to a rear side of the top.

* * * * *